US008383976B2

(12) United States Patent
Hu

(10) Patent No.: US 8,383,976 B2
(45) Date of Patent: Feb. 26, 2013

(54) SWITCH WITH ELECTRICAL MEMBER SUPPORTED IN ELASTIC FOLDED CONTACT

(75) Inventor: Yong-Hui Hu, ShenZhen (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 1228 days.

(21) Appl. No.: 12/221,600

(22) Filed: Aug. 4, 2008

(65) Prior Publication Data

US 2009/0032381 A1 Feb. 5, 2009

(30) Foreign Application Priority Data

Aug. 3, 2007 (CN) ..... 2007 2 0041188 U

(51) Int. Cl.
*H01H 1/14* (2006.01)
*H01H 13/14* (2006.01)

(52) U.S. Cl. ..... 200/534; 200/314

(58) Field of Classification Search ..... 200/534, 200/406, 314

See application file for complete search history.

(56) References Cited

U.S. PATENT DOCUMENTS 4,751,385 A * 6/1988 Van Benthusysen et al. . 200/314
7,235,754 B2 * 6/2007 Rochon et al. ..... 200/406
7,331,805 B1 * 2/2008 Hu ..... 439/188

* cited by examiner

*Primary Examiner* — Renee Luebke
*Assistant Examiner* — Lheiren Mae Caroc
(74) *Attorney, Agent, or Firm* — Wei Te Chung; Ming Chieh Chang

(57) ABSTRACT

A switch at least comprises a housing, an electrical member, a terminal and a connecting contact. The housing defining a cavity that includes two opposite sidewalls, and a pair of fixing grooves each defined by said sidewall and an extension wall spaced from said sidewall. The electrical member having a pair of leads disposed within said cavity. The terminal retained in the housing and having a contact portion abutting against said sidewall. The connecting contact retainably disposed within each said groove, and the connecting contact has a plate base abutting against said extension wall, a fixing portion attached onto an upper end of the plate base for clamping each said lead of the electrical member, and an spring portion reversely extending from an opposite bottom end of the plate base and designed to mechanically and electrically engage the contact portion of the second terminal.

17 Claims, 4 Drawing Sheets

SWITCH WITH ELECTRICAL MEMBER SUPPORTED IN ELASTIC FOLDED CONTACT

BACKGROUND OF THE INVENTION

1. Field of the Invention

The present invention relates to a switch, and particularly to a switch provided with an electrical member such as a Light Emitting Diode (LED), used in various electronic devices.

2. Description of Related Art

A conventional switch provided with a light source is described in U.S. Pat. No. 7,202,429 published on Apr. 10, 2007 and U.S. Pat. No. 7,331,805 published on Feb. 19, 2008. The U.S. Pat. No. 7,202,429 disclose a switching device, includes a vertically moveable operating member with a cavity in which a light lies. The light is supported on tongues of a pair of sheet metal energizing members. Each energizing member has laterally opposite sides that form a pair of legs. The legs extend downward along opposite sides of the switch casing, and the legs have lugs at their lower ends for soldering to traces on a circuit board. The U.S. Pat. No. 7,331,805 disclose a switch, comprises an insulative housing defining a cavity, a first, a pair of second and a third fixed terminals embedded in the insulative housing, a movable contact retained in the cavity of the insulative housing, an operator exposed above the movable contact, a retention portion positioned on the operator, an LED located above the retention portion, an actuator assembled to the insulative housing, a cover attached to a top of the insulative housing, and a gasket interposed between the insulative housing and the cover. The insulative housing has two fixing portions respectively defined in a pair of opposite sidewalls, and the LED has a pair of cantilevered arms respectively contacting with the second fixed terminals and fixed in the fixing portions of the insulative housing for immovably fastening the LED to the insulative housing. When the operator is downwardly pushed by the actuator to thereby depress the movable contact, the movable contact has a central contact portion thereof being downwardly depressed for contacting with the first fixed terminal to thereby establish an electrical connection between the first and the third fixed terminals.

Take the U.S. Pat. No. 7,331,805, and in fact for assuring of the electrical connection between the second fixed terminals and the cantilevered arms of the LED, the capacity of the fixing portion just enough to receive the cantilevered arm of the LED. But due to this reason in assembly, the cantilevered arm of the LED may burst the fixing portion of the housing.

Hence, an improved electrical connector is required to overcome the above-mentioned disadvantages of the related art.

SUMMARY OF THE INVENTION

A primary object of the present invention is to provide a switch for increasing success ratio in assembly.

To achieve the aforementioned object, a switch comprises an insulative housing having a pair of fixing grooves defined in a pair of opposite sidewalls, a first, a second and a third fixed terminals respectively provided with a first contact portion, a pair of second contact portions and a pair of third contact portions exposed to outside, a movable contact to be in contact with the third contact portions, an operator capable of depressing the movable contact, a pair of connecting contact respectively having a spring portion connecting with the second contact portion and a fixing portion opposite to the spring portion, a LED having a pair of leads respectively fixed in the fixing portions of the connecting contacts for fastening the LED to the insulative housing, and an actuator adapted for driving the operator to downwardly depress the movable contact. When the operator is downwardly pushed by the actuator, said movable contact contacting with the third fixed terminals has a central contact portion downwardly depressed by the operator for contacting with the first contact portion of the first fixed terminal to thereby establish an electrical connection between the first and the third fixed terminals.

The LED always connects with the second terminal by the connecting contact, and the connecting contact defines the spring portion for the connecting contact to flexibly inserted in the fixing groove of the insulative housing and reducing the burst probability of the fixing groove. It is beneficial for switch to reliably reduce fraction defective in assembly.

Other objects, advantages and novel features of the invention will become more apparent from the following detailed description of a preferred embodiment when taken in conjunction with the accompanying drawings.

DETAILED DESCRIPTION OF THE INVENTION

Figure 1:
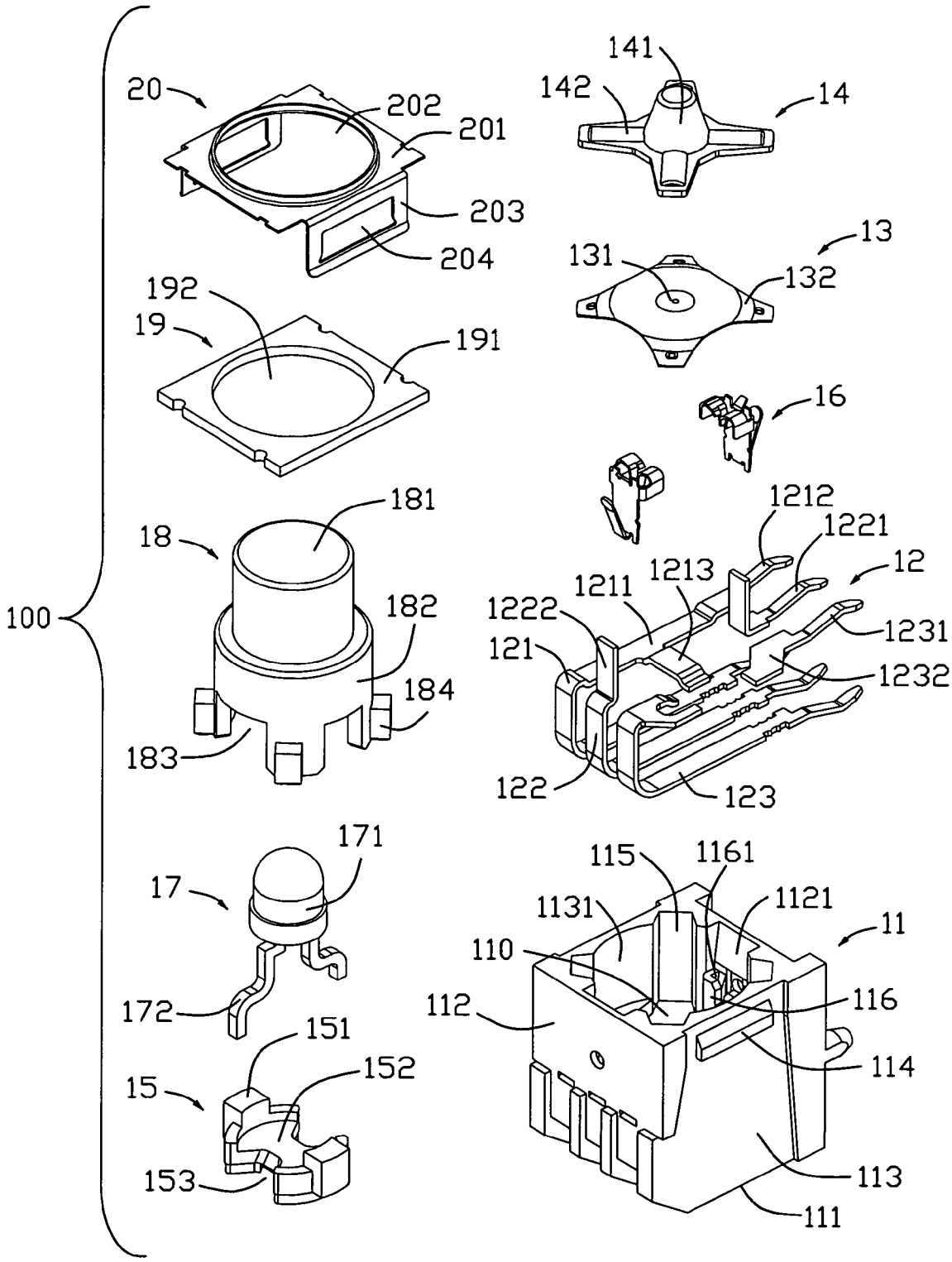
FIG. 1 is an exploded, perspective view of a switch in accordance with the present invention.

Reference will now be made to the drawing figures to describe the present invention in detail. Referring to FIG. 1, a switch 100 in accordance with the preferred embodiment of the present invention is adapted for electrically connecting with an electrical member 17, also called the LED 17. In fact, the switch 100 may also be used for other kinds of electrical member in other embodiments. The switch 100 comprises an insulative housing 11 defining a cavity 110, a plurality of fixed terminals 12 embedded in the insulative housing 11, a movable contact 13 retained in the cavity 110 of the insulative housing 11, an operator 14 exposed above the movable contact 13, a retention member 15 positioned on the operator 14, a pair of intermediate connecting contacts 16, also called the elastic folded contact 16, respectively defined on either hand of the retention member 15, an LED 17 located above the retention member 15, an actuator 18 assembled to the insulative housing 11, a cover 20 attached to a top of the insulative housing 11, and a gasket 19 interposed between the insulative housing 11 and the cover 20.

Figure 4:
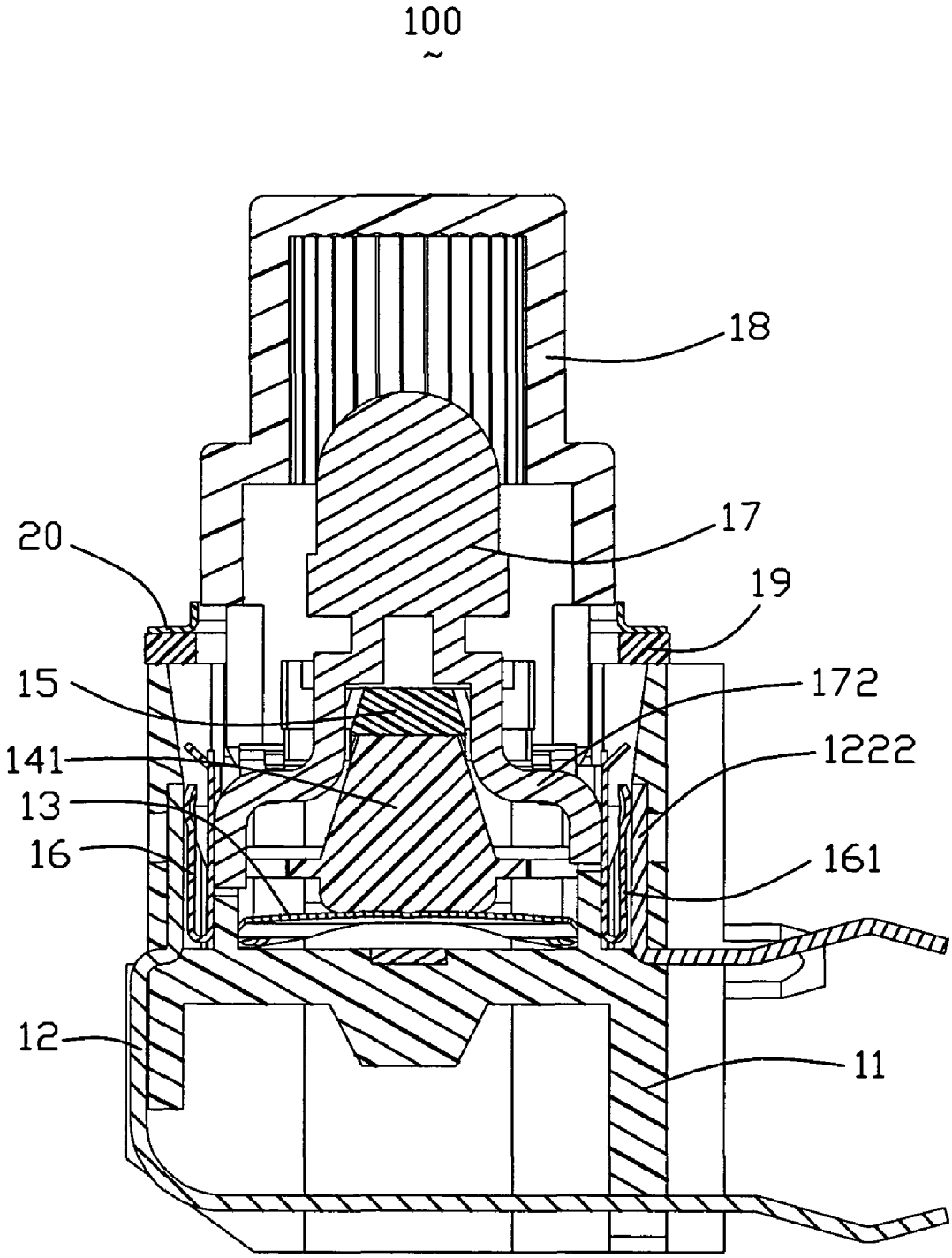
FIG. 4 is a cross-sectional view taken along line 4-4 in FIG. 3.

Referring to FIG. 4 in conjunction with FIG. 1, the insulative housing 11 is a substantially rectangular case, comprising a bottom wall 111, a pair of opposite periphery walls 112 and a pair of opposite side walls 113 raising upwardly from the bottom wall 111 to thereby define the cavity 110 therebetween. Each periphery wall 112 has an engaging slot 1121 defined thereon in a top-to-bottom direction. The pair of side walls 113 respectively have a first recess 1131 having a semi-curved surface defined in an inner surface thereof and a tuber 114 formed at an outer surface thereof. The cavity 110 has four rectangular second recesses 115 defined at four corners thereof, and a pair of fixing grooves 116 respectively surrounding corresponding engaging slots 1121. Each fixing groove 116 defines an insertion slot 1161 communicating with the engaging slot 1121 and an extension wall (not labeled) spaced from said periphery wall 112.

Referring to FIG. 1, the plurality of fixed terminals 12 each comprises a first fixed terminal 121, a second fixed terminal 122, and a third fixed terminal 123. The first fixed terminal 121 is formed with a center portion 1211 extending in a longitudinal direction, a pair of first soldering portions 1212 extending laterally along an extending direction of the center portion 1211. The center portion 1211 has a first contact portion 1213 protruding perpendicularly from a center portion 1211 thereof. The second fixed terminal 122 has a pair of second soldering portions 1221 extending parallel to the first soldering portions 1212, and a pair of second contact portions 1222 raising perpendicularly to inner ends of the second soldering portions 1221. The third fixed terminal 123 has a pair of third soldering portions 1231 extending parallel to the second soldering portions 1221, a pair of third contact portions 1232 bending obliquely from inner ends of the third soldering portions 1231.

Referring to FIG. 1, the dome-like movable contact 13 comprises a central contact portion 131 and four periphery contact portions 132 symmetrically formed around the central contact portion 131.

The operator 14 comprises a button 141 having a beveled surface and four projection beams 142 projecting radially from a lower portion of the button 141.

The retention member 15 is formed with a body portion 151 having a curved outer surface for corresponding to the first recesses 1131, a pair of indentations 153 symmetrically defined thereon, and a pair of engaging portions 152 symmetrically formed at an outer surface of the body portion 151.

Figure 2:
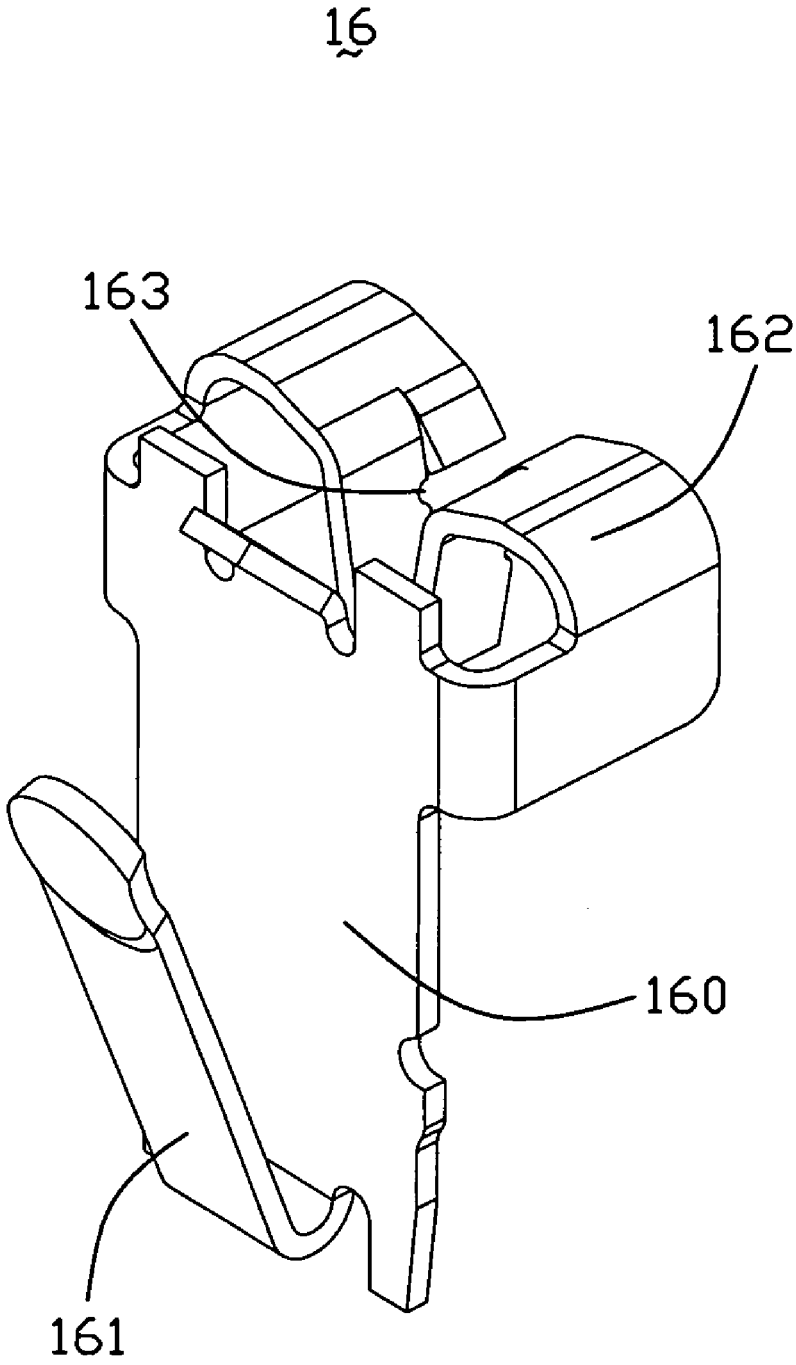
FIG. 2 is a perspective view of a connecting terminal as shown in FIG. 1.

Referring to FIG. 2, the intermediate connecting contact 16 retainably disposed within each said groove 116, and the intermediate connecting contact has a plate base 160 abutting against said extension wall, a fixing portion 162 attached onto an upper end of the plate base 160 for clamping each said upholding lead 172 of the electrical member 17, and an spring portion 161 reversely extending from an opposite bottom end of the plate base 160 and designed to mechanically and electrically engage the contact portion 1222 of the second terminal 122. In addition, the fixing portion 162 is suspended on an upper end of the extension wall, and has a space room 163 to receive the lead 172 of the LED 17.

The LED 17 comprises a light source 171 and a pair of substantially Z-shaped leads 172 extending downwardly from the light source 171 for insertion into the fixing portion 162 of the connecting contact 16 and for fixing the LED 17 in the cavity 110. In addition, the leads 172 of the LED 17 are respectively located outside of said fixing grooves 116.

The actuator 18 comprises a cylindrical base portion 182, and an upper portion 181 having a diameter smaller than that of the base portion 182. The base portion 182 has four protrusions 184 symmetrically formed around an outer surface thereof, and four cutouts 183 each defined between a pair of adjacent protrusions 184.

The cover 20 comprises a top face 201 defining an extension hole 202, and a pair of bent faces 203 extending downwardly from a pair of opposite sides of the top face 201. Each bent face 203 has an engaging groove 204 defined thereon for engaging with the tubers 114 of the insulative housing 11.

The gasket 19 is substantially a rectangular board, comprising a board portion 191 and a circular mounting hole 192 defined therein.

Figure 3:
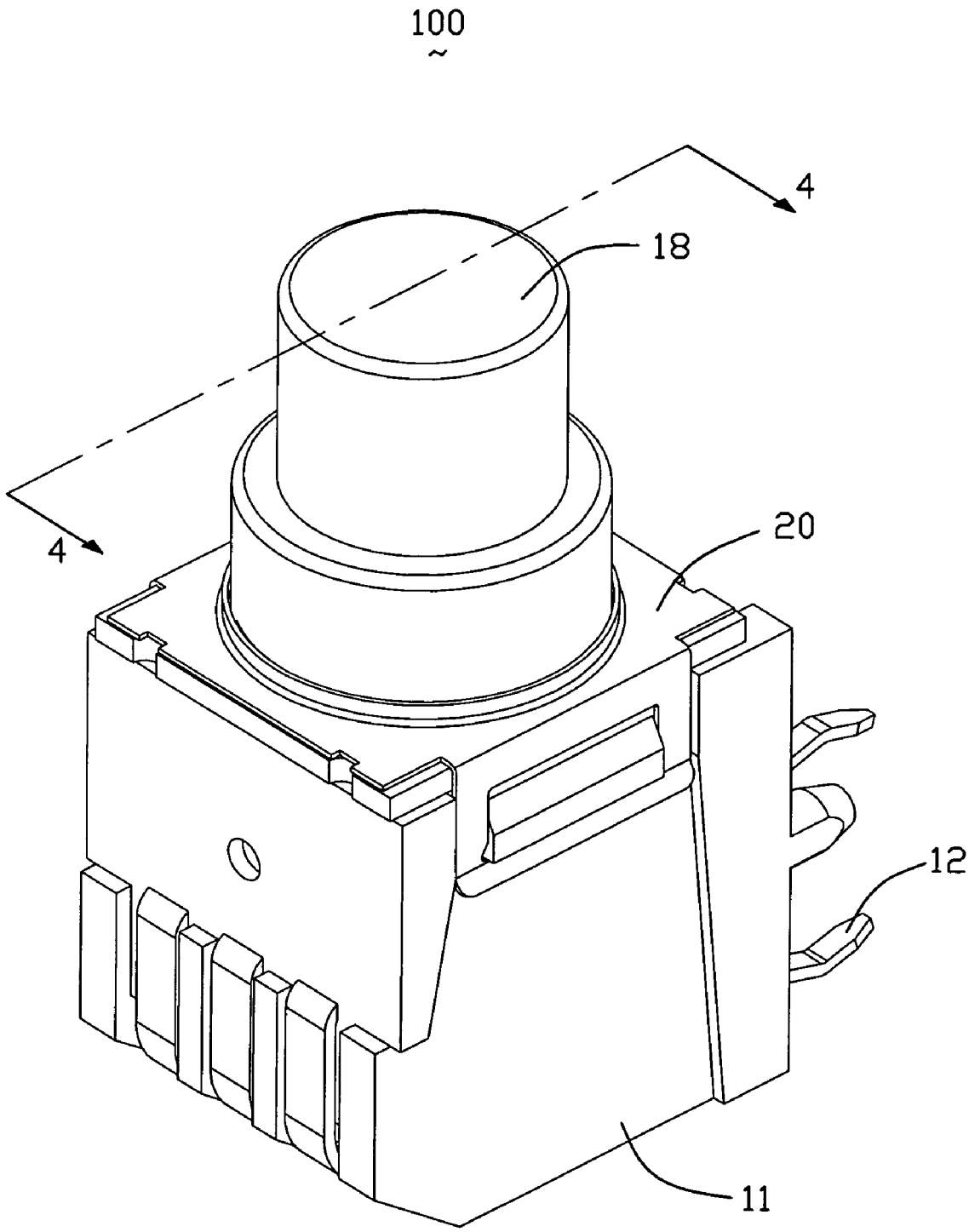
FIG. 3 is an assembled, perspective view of the switch as shown in FIG. 1.

Referring to FIGS. 1, 3, 4, in assembly of the switch 100, the plurality of fixed terminals 12 are assembled to the insulative housing 11 by insert molding, with the first, second and third soldering portions 121, 122, 123 thereof extending outside of the insulative housing 11. The first fixed terminal 121 is disposed in the insulative housing 11, with the center portion 1211 thereof embedded in the bottom wall 111 while the first contact portion 1213 thereof exposed in the cavity 110. The second fixed terminals 122 are mounted on the insulative housing 11, with the second contact portions 1222 thereof exposed in the fixing grooves 116 for contacting with the spring portion 161 of the connecting contact 16. As for the third fixed terminals 123, and the third contact portions 1232 are accommodated in the second recesses 115 and exposed in the cavity 110.

The movable contact 13 is disposed on the bottom wall 111 of the insulative housing 11, with a pair of periphery contact portions 132 thereof engaging with corresponding second recesses 115 and contacting with the third contact portions 1232 of the third fixed terminals 123, and with the central contact portion 131 positioned a certain distance above the first contact portion 1213. The operator 14 is received in the cavity 110, with the button 141 thereof positioned above the central contact portion 1213, and the projection beams 142 thereof retained in the second recesses 115 and corresponding to the periphery contact portions 132. The connecting contact 16 is received in the fixing groove 116 of the insulative housing 11 by the spring portion 161. The retention member 15 is mounted on the operator 14, with a lower surface of the body portion 151 being resisted against by the button 141, and with the engaging portions 152 engaging with the first recesses 1131. The LED 17 is fastened to the insulative housing 11, with the light source 171 thereof exposed above the retention member 15, and the leads 172 thereof extending through the indentations 153 and then being inserted into the fixing portions 162 for contacting with the second contact portions 1222.

The actuator 18 is fixed on the retention member 15, with the cutouts 183 thereof engaging with the engaging portions 152. The base portion 182 engages with the first recesses 1131, and the protrusions 184 are inserted into the corresponding second recesses 115. The light source 171 is received in the actuator 18. The gasket 19 is interposed between the cover 20 and the insulative housing 11 to ensure a proper sealing therebetween. The engaging grooves 184 thereof engage with the tubers 114. The actuator 18 extends outwardly through the mounting hole 192 and the extension hole 202 in sequence. The switch 100 is assembled as a whole finally.

In operation, the actuator 18 is downwardly pushed by exerting an external force thereon. The retention member 15 and therefore the button 141 are urged downwardly for depressing the central contact portion 131 of the movable contact 13. The LED 17 does not move even though the retention member 15 positioned therebelow moves downwardly. The movable contact 13 contacting with the third contact portion 1231 of the third fixed terminal 123 in a normal position is then forced to deform and have the central contact portion 131 downwardly depressed for contacting with the first contact portion 1213 of the first fixed terminal 121 to thereby establish an electrical connection between the first and the third fixed terminals 121, 123.

When the external force is removed, the switch 100 restores itself to a normal position due to a resilient force from a deformation of the movable contact 13 and the button 141.

In present invention, The LED 17 always connects with the second terminal 122 by the connecting contact 16, and the connecting contact 16 defines the spring portion 161 for the connecting contact 16 to flexibly inserted in the fixing groove 116 of the insulative housing 11 and reducing the burst probability of the fixing groove 116. It is beneficial for switch 100 to reliably reduce fraction defective in assembly.

Naturally, in another embodiment, the actuator 18 has an engaging portion (not shown) formed at a lower portion thereof for engaging with the operator 14. The switch 100 is assembled as a whole, with the retention member 15 being removed. In operation, the operator 14 could be downwardly pushed by the actuator 18 directly to thereby depress the movable contact 13, due to an engagement between the operator 14 and the engaging portion of the actuator 18.

However, the disclosure is illustrative only, changes may be made in detail, especially in matter of shape, size, and arrangement of parts within the principles of the invention.

What is claimed is:

1. A switch, comprising:

an insulative housing comprising two opposite side walls and a cavity formed between the side walls, each side wall defining a fixing groove;

a plurality of fixed terminals fixed in the insulative housing, the fixed terminals comprising first, second and third fixed terminals respectively provided with a first contact portion, a pair of separated second contact portions and a pair of separated third contact portions exposed in the cavity;

a movable contact residing in the cavity and comprising a deformable central contact portion;

an electrical member having a pair of leads upholding the electrical member;

a pair of elastic folded contacts respectively retainably disposed within the fixing grooves of the insulative housing, each elastic folded contact comprising one end supportably clamping the corresponding lead of the electrical member and another deflectable free end mechanically and electrically engaging with the corresponding second contact portion;

an actuator moveably assembled to the insulative housing; and an operator positioned between the actuator and the movable contact; wherein when the operator is not downwardly pushed, the movable contact bridges the pair of third contact portions of the third fixed terminal while disconnects the first contact portion of the first fixed terminal; and wherein when the operator is downwardly pushed by the actuator to thereby depress the movable contact, said central contact portion is downwardly depressed by the operator to further contact the first contact portion of the first fixed terminal so as to establish an electrical connection between the first and the third fixed terminals.

2. The switch as claimed in claim 1, wherein the one end of the elastic folded contact comprises a pair of elastic beams facing each other, the corresponding lead being inserted between and engaging with the pair of elastic beams.

3. The switch as claimed in claim 2, wherein the another deflectable free end of the elastic folded contact comprises a slant arm when the elastic folded contact is not inserted within the corresponding fixing groove, the slant arm engaging with the corresponding second contact portion to provide robust resisting force therebetween.

4. The switch as claimed in claim 3, wherein each elastic folded contact comprises a vertical base fixed in the corresponding fixing groove, the pair of elastic beams and the slant arm being located at opposite sides of the vertical base and extending along opposite directions, the pair of elastic beams protruding from a top side of the vertical base while the slant arm protrudes from a bottom side of the vertical base.

5. The switch as claimed in claim 2, wherein a passageway is formed between the pair of elastic beams with an upper wider opening for guiding insertion of the corresponding lead and a lower narrower opening for stably clamping the corresponding lead.

6. The switch as claimed in claim 1, wherein each of the second contact portions is located in a vertical plane and is perpendicular to a pair of third soldering portions of the third fixed terminals.

7. The switch as claimed in claim 1, wherein said insulative housing comprises a bottom wall, a pair of opposite periphery walls and a pair of side walls rising from the bottom wall, each of said periphery walls respectively defining an engaging slot communicating with said fixing groove for engaging with the second contact portion.

8. The switch as claimed in claim 7, wherein said insulative housing has a pair of first recesses defined on the side walls, and four second recesses defined at four corners thereof for engaging with the pair of third contact portions.

9. The switch as claimed in claim 8, wherein said actuator comprises a base portion received in the cavity, and a plurality of protrusions formed around the base portion for engaging with the second recesses.

10. The switch as claimed in claim 9, further comprising a retention member mounted between the actuator and the operator and provided with a pair of engaging portions, wherein said base portion has a pair of cutouts each defined between two adjacent protrusions for engaging with a corresponding engaging portion.

11. The switch as claimed in claim 10, wherein said retention member is formed with a body portion, a pair of indentations symmetrically defined on the body portion for extension of the leads of the electrical member.

12. The switch as claimed in claim 8, wherein said movable contact is formed as a dome-like shape and has two pairs of periphery contact portions formed around the central contact portion for engaging with the second recesses, and wherein one pair of periphery contact portions contact with the third contact portions.

13. The switch as claimed in claim 12, wherein said operator is formed with a button adapted for depressing the central contact portion and a plurality of projection beams corresponding to the periphery contact portions of the movable contact.

14. A switch comprising:

an insulative housing defining a cavity that includes two opposite side walls;

an LED device having a pair of upholding leads, which are at least partly received within said cavity;

a pair of external terminals retained in the insulative housing, each said external terminal having a contact portion engaging onto an inner face of each said side wall, and an extension leg disposed outside of the insulative housing; and an elastic folded contact fixed in said side wall, said elastic folded contact having one end supportably clamping each of the upholding leads, and another deflectable end mechanically and electrically engagable with the contact portion of said external terminal; wherein the one end of said elastic folded contact comprises a pair of elastic beams facing each other and the corresponding upholding lead is inserted between and engages with the pair of elastic beams.

15. The switch as claimed in claim 14, wherein the another deflectable free end of said elastic folded contact comprises a slant arm when said elastic folded contact is not assembled into the insulative housing, the slant arm engaging with the corresponding contact portion of the external terminal to provide robust resisting force therebetween.

16. The switch as claimed in claim 15, wherein said elastic folded contact comprises a vertical base for fastening, the pair of elastic beams and the slant arm being located at opposite sides of the vertical base and extending along opposite directions, the pair of elastic beams protruding from a top side of the vertical base while the slant arm protrudes from a bottom side of the vertical base.

17. The switch as claimed in claim 14, wherein a passageway is formed between the pair of elastic beams with an upper wider opening for guiding insertion of the corresponding upholding lead and a lower narrower opening for clamping the corresponding upholding lead.

* * * * *